US007847763B2

(12) United States Patent
Chen

(10) Patent No.: US 7,847,763 B2
(45) Date of Patent: Dec. 7, 2010

(54) METHOD FOR DRIVING PASSIVE MATRIX OLED

(75) Inventor: Shang-Li Chen, Tainan County (TW)

(73) Assignee: Himax Technologies, Inc., Tainan County (TW)

( * ) Notice: Subject to any disclaimer, the term of this patent is extended or adjusted under 35 U.S.C. 154(b) by 1185 days.

(21) Appl. No.: 11/160,105

(22) Filed: Jun. 9, 2005

(65) Prior Publication Data

US 2006/0279492 A1 Dec. 14, 2006

(51) Int. Cl.
*G09G 3/30* (2006.01)

(52) U.S. Cl. ..... 345/77; 345/76; 345/78; 345/83

(58) Field of Classification Search ..... 345/76–84, 345/204, 690
See application file for complete search history.

(56) References Cited

U.S. PATENT DOCUMENTS

| | | | | |
|---|---|---|---|---|
| 7,224,332 | B2 * | 5/2007 | Cok | 345/76 |
| 2002/0167471 | A1 | 11/2002 | Everitt | 345/76 |
| 2002/0167474 | A1 * | 11/2002 | Everitt | 345/82 |

* cited by examiner

*Primary Examiner*—Sumati Lefkowitz
*Assistant Examiner*—Seokyun Moon
(74) *Attorney, Agent, or Firm*—Jianq Chyun IP Office

(57) ABSTRACT

A method for driving a passive matrix organic light emitting diode (PMOLED) is provided. A pulse width modulation (PWM) constant current is provided to OLED pixels connected to a segment of a PMOLED array without voltage pre-charging the segment. Then, an offset value corresponding to missing gray scales of the OLED pixel is determined. According to the missing gray scales, the gray scales of the OLED pixel are rescaled starting from the offset. The OLED pixel is thus driven by a compensated PWM constant current having the rescaled gray scales during each horizontal line period.

6 Claims, 5 Drawing Sheets

METHOD FOR DRIVING PASSIVE MATRIX OLED

BACKGROUND OF THE INVENTION

1. Field of the Invention

This invention relates in general to a method for driving a display device. More specifically, the present invention relates to a method for driving a passive matrix organic light emitting diode (PMOLED).

2. Description of Related Art

FIG. 1 schematically shows a typical PMOLED array for describing its conventional driving method. Referring to FIG. 1, a PMOLED array 100 comprises a plurality of segments $X_1, X_2, X_3, \ldots, X_n$ and a plurality of scan lines $Y_1, Y_2, Y_3, \ldots, Y_m$, wherein the segments $X_1, X_2, X3, \ldots$, Xn and the scan lines $Y_1, Y_2, Y_3, \ldots, Y_m$, are respectively intersected to form an array. The PMOLED array 100 further comprises a plurality of OLEDs 12, and each OLED 12 is connected between one segment and one scan line to form the PMOLED array 100. In addition, each of the segments $X_1, X_2, X_3, \ldots, X_n$ are connected to a constant current source I, and the constant current source I provides a PWM (pulse with modulation) constant current to drive the OLEDs 12 connected to the segments Xi (i=1~n).

FIG. 2 is a schematic timing diagram for driving segments of the PMOLED. According to the conventional method of driving the PMOLED, when one scan line is selected by asserting a scan pulse during a particular horizontal line period T, the segment is first pre-charged. In this way, parasitic capacitors of the selected and the non-selected pixels on the segment are pre-charged with a constant voltage, so that the pixel is in a critical state and prepared to be turned on. After the pre-charge period T0, the PWM constant current I is applied to the selected segment to drive the OLED 12 of the pixel.

In the cycle of applying the PWM constant current, the gray scale of the selected pixel can be presented. Ideally, the gray scale of the selected pixel is proportional to the pulse width of the PWM constant current. However, it is very difficult to choose a proper voltage to pre-charge the segment. If the pre-charge voltage is not properly chosen, there might be an under pre-charge or an over pre-charge problem. As a result, the pixel might be over pre-charged and thus a poor display contrast occurs. Alternatively, the pixel might be under pre-charged, and missing gray scales occur at low gray levels.

FIG. 3 is a concept illustration showing an over pre-charge and an under pre-charge according to the conventional PMOLED driving method. In FIG. 3, the brightness and the gray scale of the pixel are normalized to 1. Referring to FIG. 3, the diagonal solid line represents the ideal condition, i.e., the brightness and the gray scale are proportional. For example, the brightness "0" is corresponding to the gray scale "0". However, if the under pre-charge condition occurs as represented by the line II, missing gray scales x occurs. Namely, when the brightness is "0", its corresponding gray scale is "x", rather than "0". The gray scales smaller than "x" are disappeared, and the gray scales 0 to x−1 can not be displayed for the selected pixel. On the other hand, if the over pre-charge condition occurs as represented by the line I, the contrast of the selected pixel becomes poor because the pixel has been light ON even at gray scale 0.

As described above, since it is difficult to select a suitable pre-charge voltage to pre-charge the selected segment, the over and the under pre-charge conditions always occur, and the image quality for the PMOLED display device is adversely affected. Therefore, it is desired to a new method to overcome the over and the under pre-charge issues due to the pre-charge process without changing the basic circuit design.

SUMMARY OF THE INVENTION

According to the foregoing description, an object of this invention is to provide methods for driving a passive matrix OLED array to solve the over and the under pre-charge conditions.

Another object of this invention is to provide methods for driving a passive matrix OLED array to solve the over and the under pre-charge conditions.

According to the objects mentioned above, the present invention provides a method for driving a passive matrix OLED array. The method comprises at least following steps. A pulse width modulation (PWM) constant current is provided to OLED pixels connected to a segment of a PMOLED array without voltage pre-charging the segment. The offset value corresponding to the missing gray-scales is determined. Then, the gray scales are rescaled starting from the offset. The OLED pixel is driven by a compensated PWM constant current having the rescaled gray scales during each horizontal line period.

In addition, the present invention further provides a method for driving a color passive matrix organic light emitting diode (PMOLED). The method comprises at least following steps. Pulse width modulation (PWM) constant currents are provided to OLED pixels connected to a segment of a PMOLED array without voltage pre-charging the segment, wherein each of the OLED pixels comprises a plurality of prime color OLEDs. Then, offset values corresponding to the missing gray-scales of respective prime color OLEDs are determined. The gray scales of each prime color OLED are respectively rescaled starting from the corresponding offset, and a common horizontal line period for the prime color OLEDs is determined. The OLED pixel are driven by compensated PWM constant currents, wherein each compensated PWM constant current has the rescaled gray scales corresponding to each prime color OLED during each common horizontal line period.

In one aspect of the present invention, the common horizontal line period is determined by "a number of the gray scales−1+an offset value corresponding to the maximum value of the missing gray-scale values". In addition, the prime color OLEDs can comprise a red, a green and a blue color OLEDs (a RGB color system), or other color systems.

According to the method of the present invention, the segments of the PMOLED are not pre-charged before applying the PWM constant current. Therefore, the poor contrast due to the over-charge and the missing gray scales due to the under pre-charge can be solved and improved. In addition, the method can be applied to a monochrome or a color system without increasing a burden of redesigning circuit components.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings.

DESCRIPTION OF THE PREFERRED EMBODIMENT

Figure 4:
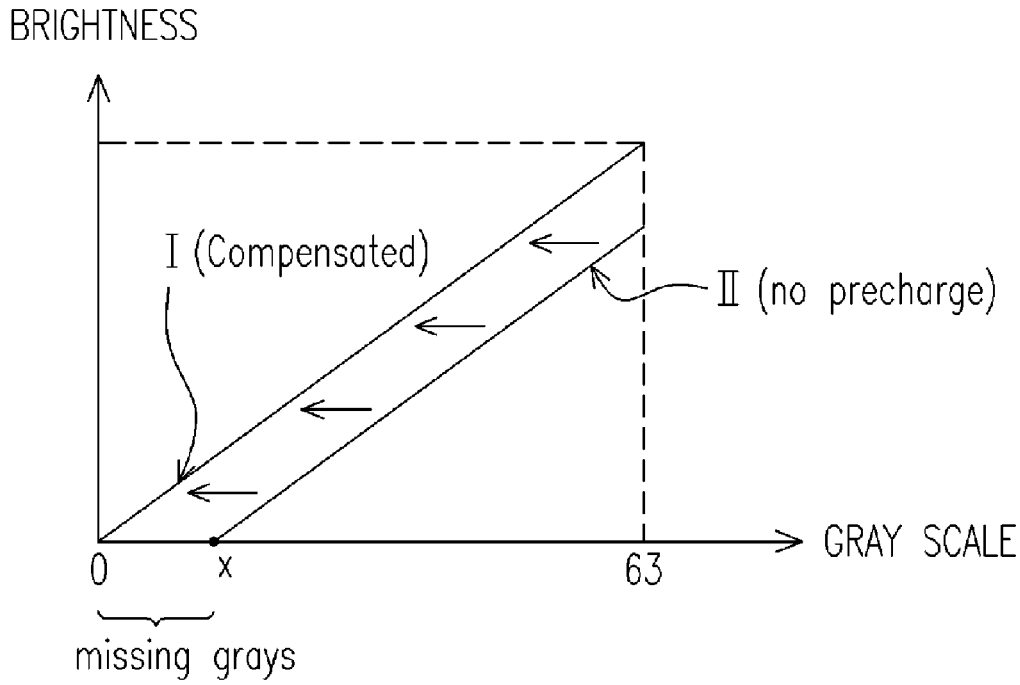
FIG. 4 shows a concept illustration according to the present invention.

FIG. 4 shows a concept illustration according to the present invention. Referring to FIG. 4, if each segment is directly driven by the PWM constant current without being pre-charged, the relationship between the brightness and the gray scale is shown by the curve II. Clearly, there would be a missing part of the gray scales, i.e., the gray scales of 0 to x−1 are missed. The brightness corresponding to the gray scales 0 to x are 0, and the gray scales 0 to x cannot be distinguished. To compensate the missing gray scales, the present invention provides a solution to rescale the gray scale. Followings will discuss how to rescale the gray scale.

Figure 1:
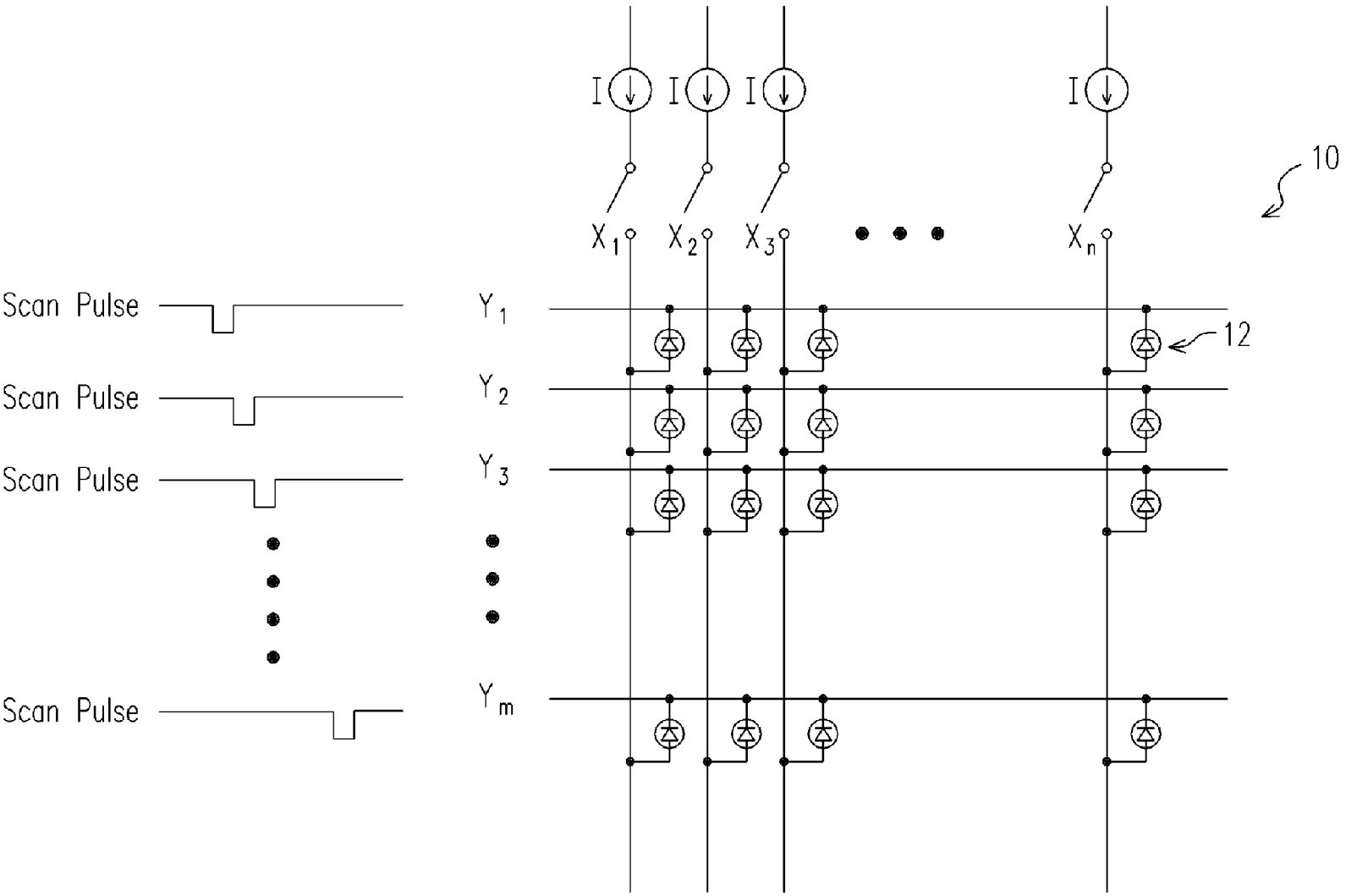
FIG. 1 (PRIOR ART)
FIG. 1 schematically shows a typical PMOLED array.
Figure 5:
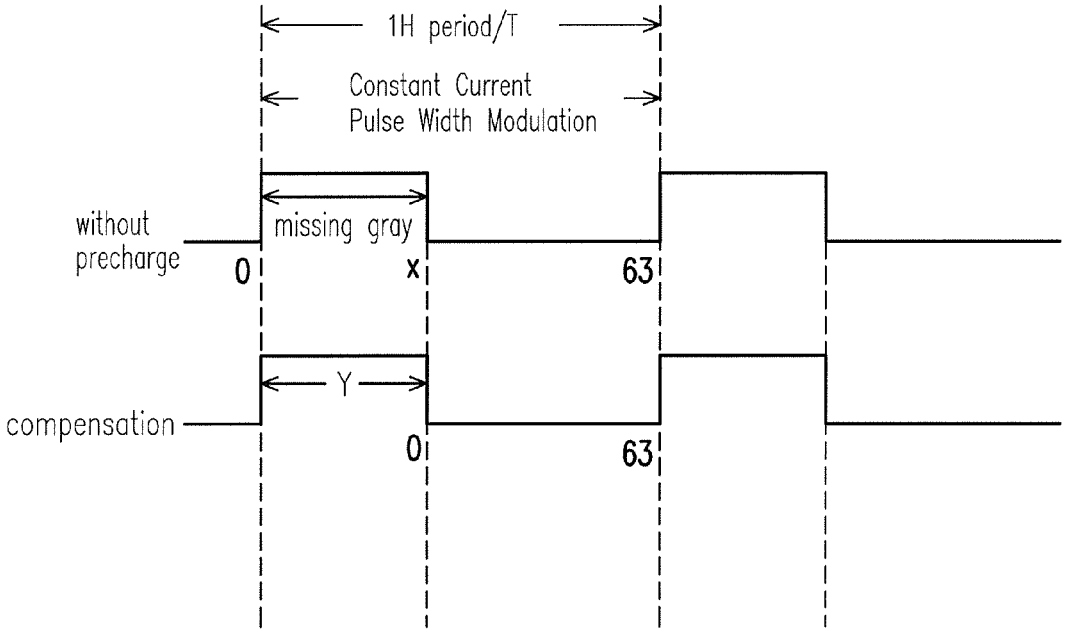
FIG. 5 shows a schematic timing diagram according to the embodiment of the present invention.

FIG. 5 shows a schematic timing diagram according to the embodiment of the present invention. The basic PMOLED array structure is the same as the conventional, but its driving method is completely different. The key point of the present invention is that no pre-charge process is required for each segment during each horizontal scan period T. Referring to FIGS. 1 and 5, when a scan line is activated by a scan pulse, a PWM constant current is provided to OLEDs 12 connected to the same data line (segment) of the PMOLED array 10.

Figure 2:
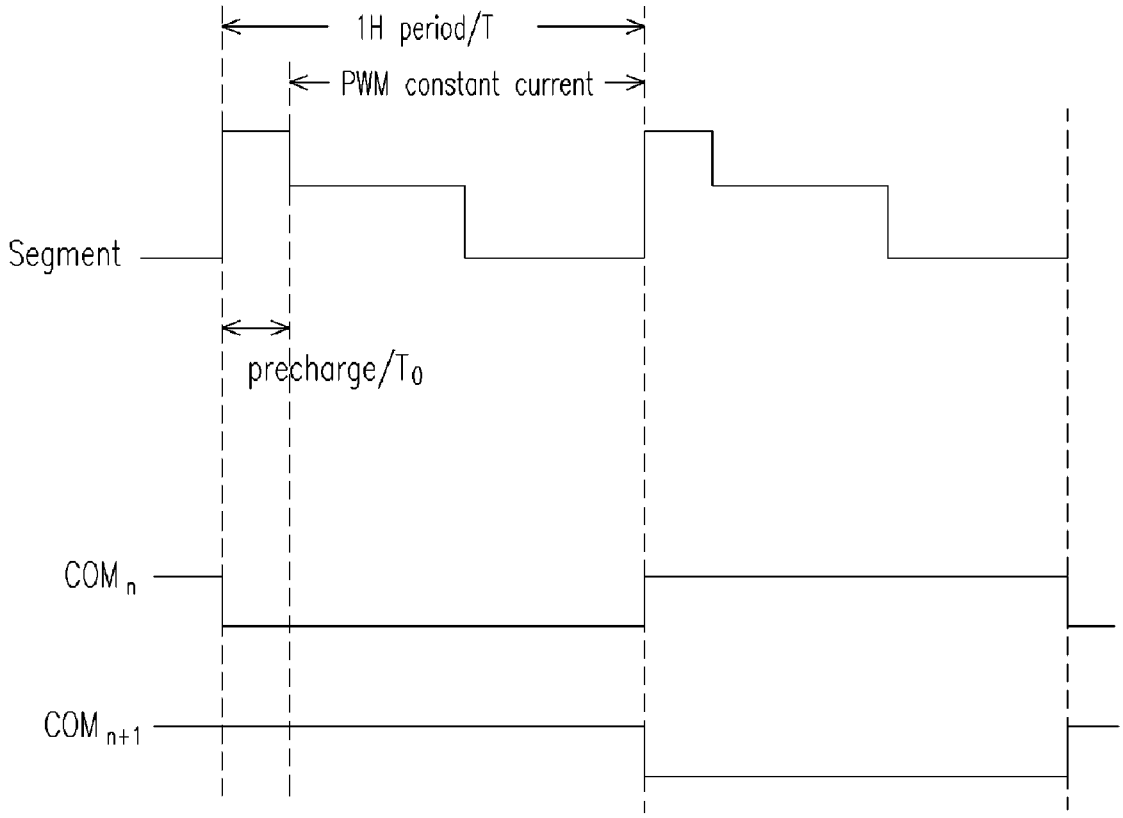
FIG. 2 (PRIOR ART)
FIG. 2 shows a schematic timing diagram according to a conventional PMOLED driving method with a pre-charge process.
Figure 3:
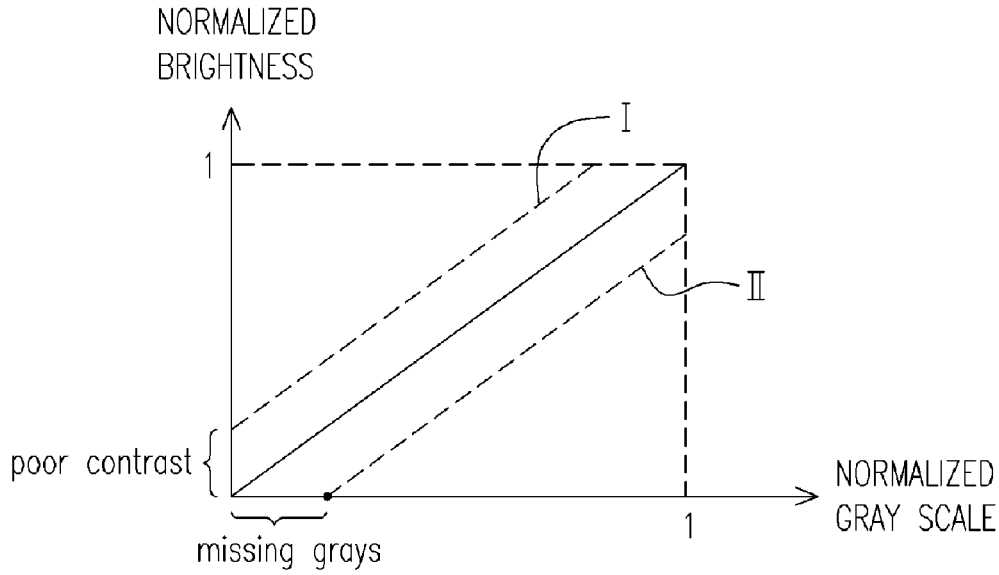
FIG. 3 (PRIOR ART)
FIG. 3 is a concept illustration showing an over pre-charge and an under pre-charge according to the conventional PMOLED driving method.

Referring to FIG. 5, the PWM constant current is directly applied to each segment without the pre-charge period $T_0$ as shown in FIG. 2. In the embodiment of the present invention, sixty-four gray scales (0 to 63) are used as an example. As described above, when the pre-charge process is not performed, the gray scale can be only specified starting from the gray scale x to 63. As a result, the gray scales 0 to x−1 are missed. In order to retrieve the missing gray scales, a zero point of the gray scales has to be redefined, and the whole gray scales are rescaled.

As the PWM constant current is applied, a missing gray-scale value x is determined first. The period of missing gray-scales is then defined as the offset value for the following resealing process. Then, as shown in the compensated PWM waveform, the zero point of the new gray scales is moved from "0" to "x" of the original gray scale. The gray scales are rescaled starting from the offset value. Then, the compensated PWM constant current is used to drive the OLEDs 12 connected on the segment.

Since the gray scales are rescaled, the full gray sales can be presented without any missing parts. For example, the width of the PWM constant current can be modulated to the gray scale 20, and thus a gray scale 20 can be specified.

In compensated PWM, 1 H period is composed of y cycles of offset and the 63 cycles for gray scales. In order to keep the same period to compensate the x missing gray scales, the offset value, y, and the missing gray scales, x, must satisfy the following relationship:

$$y/(63+y)=x/63 \quad (1)$$

$$Y=63\cdot x/(63-x) \quad (2)$$

According to the equations (1) and (2), the cycles of the compensated PWM constant current can be calculated from the offset value of the gray scale.

Figure 6:
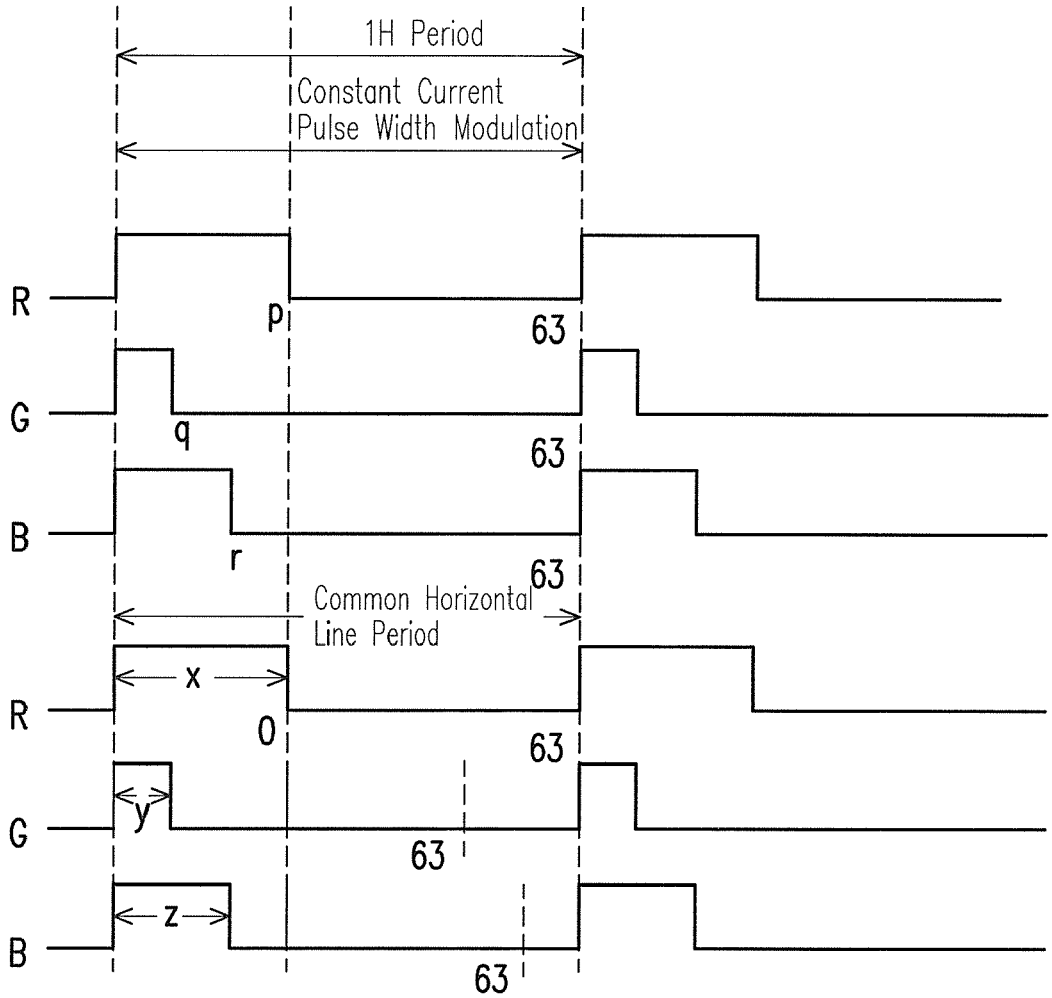
FIG. 6 shows a schematic timing diagram according to another embodiment of the present invention.

In the aforementioned embodiment, a driving method for a monochrome PMOLED is described. The method for driving a color PMOLED is almost the same. However, the characteristics and threshold voltages for OLEDs with different colors, such as red (R), green (G) and blue (B), are different. Therefore, the aforementioned method has to be modified. FIG. 6 shows a schematic timing diagram according to another embodiment of the present invention. In the embodiment, the RGB color system is used as an example and the method of the present invention can be applied to the other color systems.

In a RGB color system, the color of each pixel is composed by the prime colors, i.e., the red, green and blue colors. For each color component, the R, G and B OLED corresponding to the pixel are respectively driven by a PWM constant current. For driving a color OLED pixel, the periods of driving the R, G and B components are the same. Similar to the previous embodiment, the segment is not voltage pre-charged before the PWM constant current is applied.

Due to the material characteristics and the threshold voltage of the R, G and B OLEDs, the missing gray scales corresponding to the R, G and B components are different, and the period of driving the individual color might be different. Therefore, in addition to rescaling the gray scales for each color component, a common horizontal line period for the R, G and B components has to be determined. In the embodiment, 64 gray scales is an example for each color component.

In this embodiment, the method comprises at least following steps providing pulse width modulation (PWM) constant currents to OLED pixels connected to a segment of a PMOLED array without voltage pre-charging the segment, wherein each of the OLED pixels comprises a plurality of prime color OLEDs; determining the offsets corresponding to the missing gray scales of respective prime color OLEDs; rescaling the gray scales of each prime color OLED starting from the corresponding offset; determining a common horizontal line period for the prime color OLEDs; and driving the OLED pixel by compensated PWM constant currents, wherein each compensated PWM constant current has the rescaled gray scales corresponding to each prime color OLED during each common horizontal line period. The detailed description is explained as follows.

Referring to FIG. 6, the missing gray scales corresponding to the R component is "p", the missing gray scales corresponding to the G component is "q" and the missing gray scales corresponding to the B component is "r". In this embodiment, p as the maximum of p, q, and r is used as an example. Then the maximum offset "x" corresponding to "p" missing gray scales can be calculated according to equation (2). And the total cycle numbers of 1 H in the time scale is 63+x. The offset value y for color G and z for color B can then be calculated in the new time scale with 63+x cycles as 1 H period.

Since the gray scales of the prime color OLEDs are rescaled, the full gray sales can be presented without any missing parts. For example, if a gray scale of 30 is to be presented for the R component, the width of the corresponding PWM constant current can be modulated to have a width of x+30. Because the zero point of the gray scales is rescaled and shifted to "x", a gray scale of 30 can be specified.

As described above, since the PMOLED array are driven without voltage pre-charging the segment and the gray scales are rescaled to retrieve the missing gray scales, the poor contrast due to the over-charge and the missing gray scales due to the under pre-charge can be solved and improved.

In addition, since the aforementioned method can be achieved by a software method, the circuit components for driving the PMOLED array are basically the same. Therefore, the cost will not be increased.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What is claimed is:

1. A method for driving a passive matrix organic light emitting diode (PMOLED) array, the method comprising:

providing a pulse width modulation (PWM) constant current to an OLED pixel through a segment of the PMOLED array connected to the OLED pixel directly when a scan line of the PMOLED array connected to the OLED pixel is activated by a scan pulse, wherein the segment is not pre-charged before the PWM constant current is provided to the OLED pixel, and wherein the OLED pixel displays a plurality of gray scales in response to the PWM constant current;

determining an offset value Y corresponding to missing gray scales X in the plurality of gray scales of the OLED pixel, the missing gray scales being caused by not pre-charging the segment, and the missing gray scales being not caused by aging of organic materials of the OLED pixel;

setting a zero point of the plurality of gray scales to the offset value, and rescaling the gray scales starting from the offset value to obtain a compensated PWM constant current; and driving the OLED pixel by the compensated PWM constant current corresponding to the rescaled gray scales during each of a plurality of horizontal line periods, wherein $Y=Z*X/(Z-X)$, where Z is the number of the plurality of gray scales of the OLED pixel.

2. The method according to claim 1, wherein the gray scales are rescaled by a software method.

3. A method for driving a color passive matrix organic light emitting diode (PMOLED) array, the method comprising:

providing pulse width modulation (PWM) constant currents to an OLED pixel through respective segments of the PMOLED array connected to the OLED pixel directly when a scan line of the PMOLED array connected to the OLED pixel is activated by a scan pulse, wherein the segments are not pre-charged before the PWM constant currents are provided to the OLED pixel, the OLED pixel comprises a plurality of prime color OLEDs, and the plurality of prime color OLEDs display a plurality of gray scales in response to the respective PWM constant currents;

determining a maximum offset value Y corresponding to a maximum of missing gray scales X among the prime color OLEDs, the missing gray scales of each prime color OLED being caused by not pre-charging the segments, and the missing gray scales being not caused by aging of organic materials of the OLED pixel;

determining a common horizontal line period for the prime color OLEDs based on the maximum offset value;

determining offset values for the other prime color OLEDs;

respectively setting a zero point of the plurality of gray scales of each prime color OLED to the corresponding offset values, and resealing the gray scales of each prime color OLED starting from the corresponding offset values to obtain compensated PWM currents; and driving the OLED pixel by the compensated PWM constant currents, wherein each compensated PWM constant current has the rescaled gray scales corresponding to each prime color OLED during each of a plurality of common horizontal line periods, wherein $Y=Z*X/(Z-X)$, where Z is the number of the plurality of gray scales of the OLED pixel.

4. The method according to claim 3, wherein the common horizontal line period is determined by (a total number of the gray scales−1)+(the maximum offset value corresponding to the maximum of the missing gray scales).

5. The method according to claim 3, wherein the prime color OLEDs comprises a red, a green and a blue color OLEDs.

6. The method according to claim 3, wherein the gray scales are rescaled by a software method.

* * * * *